US006105382A

United States Patent [19]

Reason

[11] Patent Number: 6,105,382

[45] Date of Patent: Aug. 22, 2000

[54] CHEST MOUNTED ARMORED MICROCLIMATE CONDITIONED AIR DEVICE

[75] Inventor: William B. Reason, Lexington Park, Md.

[73] Assignee: The United States of America as represented by the Secretary of the Navy, Washington, D.C.

[21] Appl. No.: 09/280,731

[22] Filed: Mar. 29, 1999

[51] Int. Cl.[7] ..... F25D 23/12

[52] U.S. Cl. ..... 62/259.3; 165/46

[58] Field of Search ..... 62/259.3, 480; 165/46, 104.12

[56] References Cited

U.S. PATENT DOCUMENTS

| | | | |
|---|---|---|---|
| 4,459,822 | 7/1984 | Pasternack | 62/259.3 |
| 4,914,752 | 4/1990 | Hinson et al. | 62/5 X |
| 4,998,415 | 3/1991 | Larsen | 62/259.3 X |
| 5,201,365 | 4/1993 | Siegel | 62/259.3 X |
| 5,320,164 | 6/1994 | Szczesuil et al. | 165/46 |
| 5,535,817 | 7/1996 | Dunne | 165/104.12 |

*Primary Examiner*—William Doerrler
*Assistant Examiner*—Chen-Wen Jiang
*Attorney, Agent, or Firm*—Ron Billi

[57] ABSTRACT

A cooling and heating device that may be used in conjunction with a personal air conditioned apparatus is disclosed. The cooling and heating device not only cools the user of the personal conditioned air apparatus, but provides for heating a user by harnessing the by-product of the cooling process, as well as provides ballistic protection for the person using the personal conditioned air apparatus.

24 Claims, 3 Drawing Sheets

CHEST MOUNTED ARMORED MICROCLIMATE CONDITIONED AIR DEVICE

STATEMENT OF GOVERNMENT'S INTEREST

This invention described herein, may be manufactured or used by and for the Government of the United States of America for governmental purposes without the payment of any royalty thereon or therefor.

BACKGROUND OF THE INVENTION 1.0 Field of the Invention

The present invention relates to providing an apparatus for conditioned air and, more particularly, to a system that employs a cooling apparatus that provides personal cooling and heating, while at the same time provides ballistic protection for the user.

2.0 Description of the Prior Art

A person's ability to accurately and repeatedly perform assigned tasks is dependent, in part, on the temperature of the environment in which the person is placed. If this environment can be maintained at a relatively constant temperature, such as achievable by heating and cooling apparatuses, the ability of a person to perform the tasks increases.

A suitable environment is radically destroyed for persons employed in combat conditions where the persons are subjected to all-too-natural elements of weather, as well as dangerous conditions. In anticipation of the need to wage combat in inclement weather, all attempts are made to limit the exposure with the best possible garments so as to protect the armed forces from the extremes of hot and cold. Prolonged unprotected exposure to the elements markedly increases a fighting forces casualty rate, especially when those elements are at the extreme ends of the environmental spectrum, wherein one may experience hot temperatures during daytime operations with steep slides into low temperatures at night. The human body does not function at peak efficiency without some degree of protection against the environmental extremes. Hot weather requires light arid types of materials with footwear that is light and dries quickly. Cold weather operations require heavy coats, jackets, parkas and boots or multiple layers of a lighter-weight material. It is desired to provide one system or garment donned by an individual that meets the demands of the two different weather conditions.

In addition to extreme weather conditions, the armed forces are subjected to battle field conditions including chemical and/or biological warfare threat. It is desired to provide a garment donned by an individual that provides ballistic protection as well as protection from chemical and biological warfare threats.

OBJECTS OF THE INVENTION

It is a primary object of the present invention to provide a unit for conditioned air that can be used to provide personal cooling and heating.

It is a further object of the present invention to provide a unit for cooling with a stream of fluid, such as air, that allows for removing heat from the body that is in a sealed garment.

It is another object of the present invention to provide a personal conditioned air apparatus that utilizes a cooling unit that also provides ballistic protection.

SUMMARY OF THE INVENTION

The present invention is directed to a unit for cooling by the utilization of a circulating stream of fluid, that is, air.

In one embodiment of the present invention, the unit comprises a housing with four enclosed sidewalls, an enclosed bottom, and a face with a covering of a material having an impact resistance characteristic. The sidewalls include two oppositely disposed sidewalls, one with an entrance opening and the other with an exit opening. The entrance opening is capable of receiving a fluid having a predetermined flow rate and the exit opening is capable of passing the fluid out of the housing. The unit further comprises a plurality of tubes arranged, in a side-by-side manner, within the housing and containing a refrigerant therein. The housing is filled with polystyrene.

In another embodiment, the unit is used as part of a personal cooling apparatus that also comprises a garment, and a plurality of fluid couplers. The garment has vents and is capable of being donned by a user. The garment, in one embodiment, completely covers and encompasses the user except for the head and the hands, while in another embodiment the head may also be covered. The personal cooling apparatus further comprises a source having an input, and an output. The plurality of fluid couplers comprises first and second couplers each having an input and an output. The first coupler having its input connected to the output of the source of fluid and its output coupled to the entrance opening of the unit. The second coupler has its input connected to the exit opening of the unit and its output distributed within the garment.

BRIEF DESCRIPTION OF THE DRAWINGS

These and other objects, features and advantages of the invention, as well as the invention itself, will become better understood by reference to the following descriptions when considered in conjunction with the accompanying drawings, wherein like reference numbers designate identical or corresponding parts throughout and wherein.

DETAILED DESCRIPTION OF THE PREFERRED EMBODIMENTS

Figure 1:
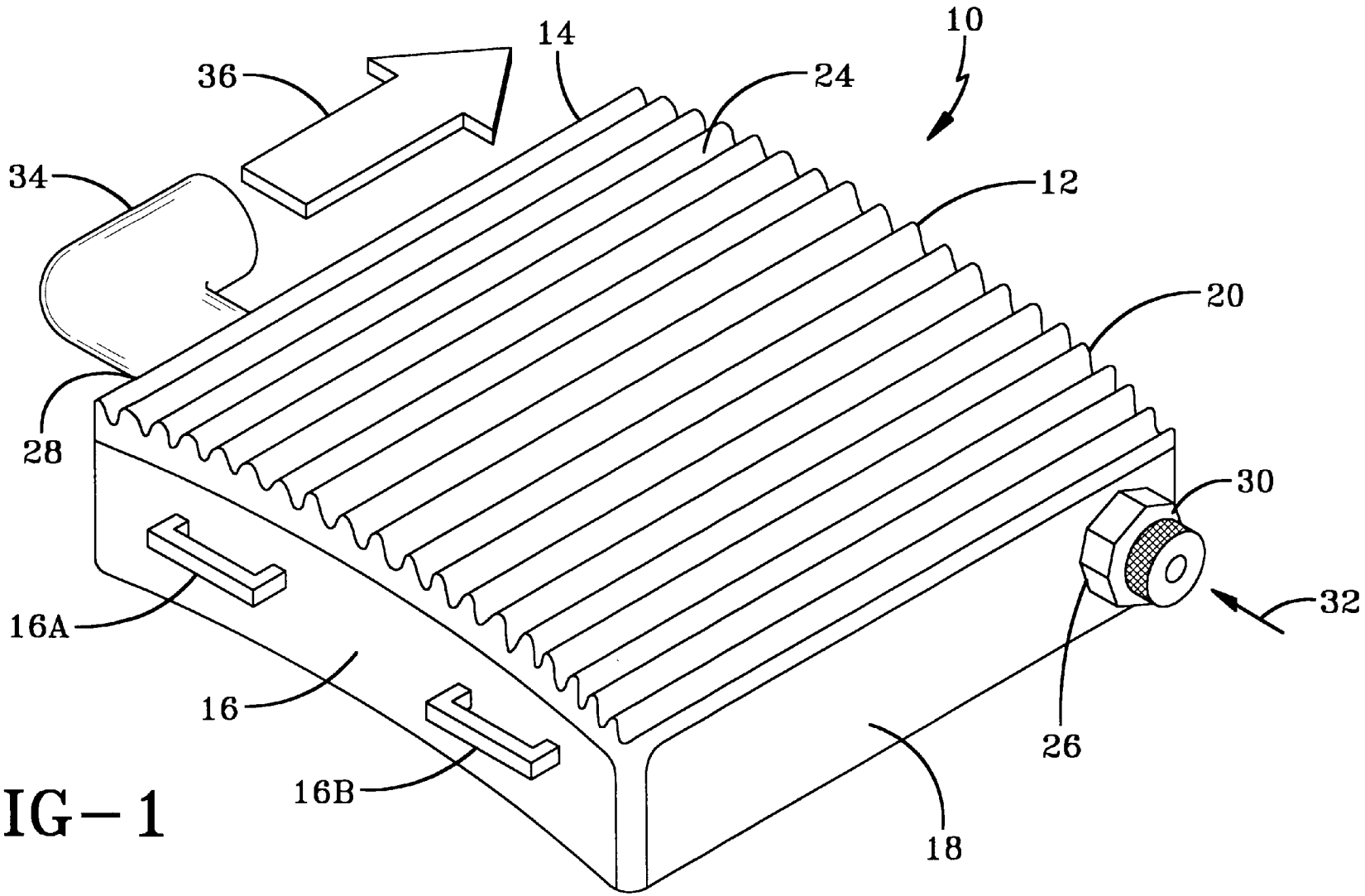
FIG. 1 illustrates the cooling unit of the present invention.

With reference to the drawings, FIG. 1 illustrates a unit 10 for cooling with a stream of fluid such as air. The unit 10 comprises a housing 12 with four enclosed sidewalls 14, 16, 18 and 20, with sidewall 16 having harness attachments 16A and 16B. The housing 12 further comprises an enclosed bottom 22 (not fully shown), and a face 24 comprised of a material having a high impact resistant characteristic so as to provide ballistic protection. It is preferred that the material be of Kevlar® i.e. para-aramid or similar layered carbon fiber product material with similar high impact characteristic. It is further preferred that all of the housing 12, and including the tubes therein to be described, be composed of this Kevlar® material having a high impact resistant characteristic Kevlar® is para-aramid which is a polymeric material e.g. fibers derived from paraphenylene terephthalamide, and is a registered trademark of the DuPont Company.

The face 24 has an outer surface which is convoluted and, similarly, the enclosed bottom 22, the sidewalls 14, 18 and 20 (see FIG. 2), are preferred to have a convoluted outer surface. The convoluted surface of the housing 12 provides more surface area for heat dissipation during the cooling, as well as providing for an angled surface that would present ballistic impact deflection of a projectile.

The sidewalls 12, 14, 16 and 18 of the housing 12 preferably have a length in the range from about 12 inches to about 14 inches and a height of about 1.5 inches. The bottom 22 has a length in the range of about 12 inches to about 14 inches and a width in the range from about 12 inches to about 14 inches. The face 24 also has a length in the range from about 12 inches to about 14 inches and a width in the range of about 12 to 14 inches.

Figure 2:
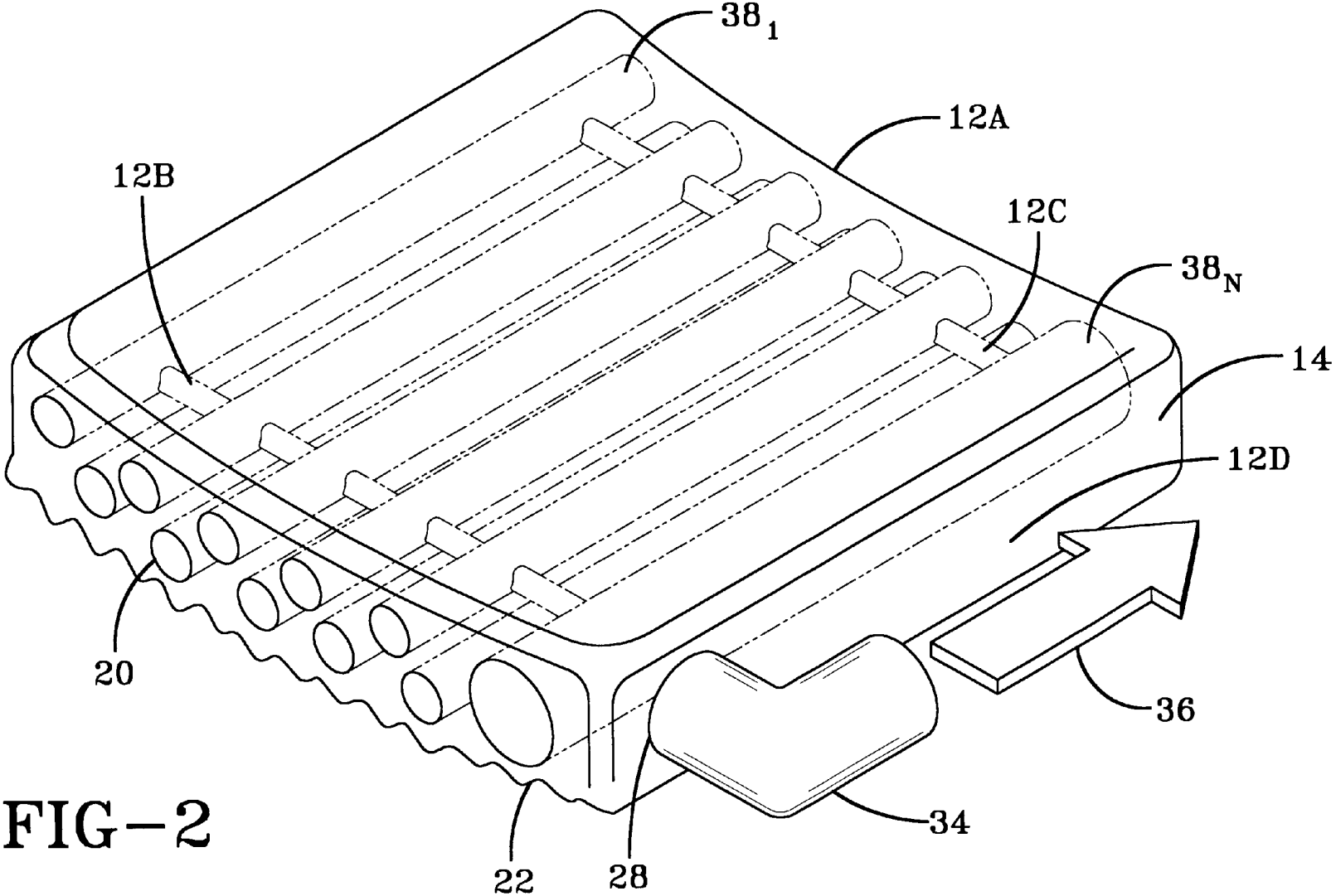
FIG. 2 also illustrates the cooling unit of FIG. 1, but is arranged to illustrate the placement of the cooling tubes within the housing of the cooling unit of FIG. 1.

The sidewalls 14 and 18 are oppositely disposed from each other with sidewall 18 having an entrance opening 26 serving as an input port and sidewall 14 having an exit opening 28 (not fully shown) serving as an output port. The entrance opening 26 has a fluid coupler 30 for receiving a fluid indicated by directional arrow 32 and having a predetermined flow rate. The fluid coupler 30 is preferably a thumbscrew coupling valve, known in the art. The exit opening 28 has a fluid coupler 34 and passes the fluid out of the housing as indicated by directional arrow 36. The unit 10 further comprises a plurality of tubes $\mathbf{38}_1 \ldots \mathbf{38}_N$ which may be further described with reference to FIG. 2 that illustrates the unit 10 of FIG. 1 but does so in a manner so as to expose and more clearly illustrate the plurality of tubes $\mathbf{38}_1 \ldots \mathbf{38}_N$. As seen in FIG. 2, the plurality of tubes $\mathbf{38}_1 \ldots \mathbf{38}_N$ are situated in an inner housing 12A and interspersed from each other by interconnecting support tubes 12B and 12C. The interior spaces of the inner housing 12A not occupied by the tubes $\mathbf{38}_1 \ldots \mathbf{38}_N$ are filled with a polymer material 12D, such as polystyrene. The plurality of tubes $\mathbf{38}_1 \ldots \mathbf{38}_N$ are arranged and interconnected in a side-by-side manner within the inner housing 12A and contain a refrigerant. As further seen in FIG. 2, the plurality of tubes $\mathbf{38}_1 \ldots \mathbf{38}_N$ are arranged in a side-by-side manner parallel to the sidewall 14 having the exit opening 28 therein. As mentioned, each of the tubes $\mathbf{38}_1 \ldots \mathbf{38}_N$ is preferably comprised of Kevlar® para-aramid and contains a refrigerant which preferably comprises Zeolite.

In operation, the fluid flow indicated by directional arrow 32 is air and is drawn from a blower (to be described with reference to FIG. 3) so that the air flows across the tubes $\mathbf{38}_1 \ldots \mathbf{38}_N$ containing the Zeolite and, for the embodiment of FIG. 1, exits the opening 34 indicated by directional arrow 36 and experiences a temperature decrease in the range from about 4° F. to about 6° F. In operation, the unit 10 provides for cooling by filling the internally mounted tubes $\mathbf{38}_1 \ldots \mathbf{38}_N$ with the refrigerant Zeolite and drawing the air across the tubes $\mathbf{38}_1 \ldots \mathbf{38}_N$. The unit 10 finds many applications and, one such application may be further described with reference to FIG. 3.

Figure 3:
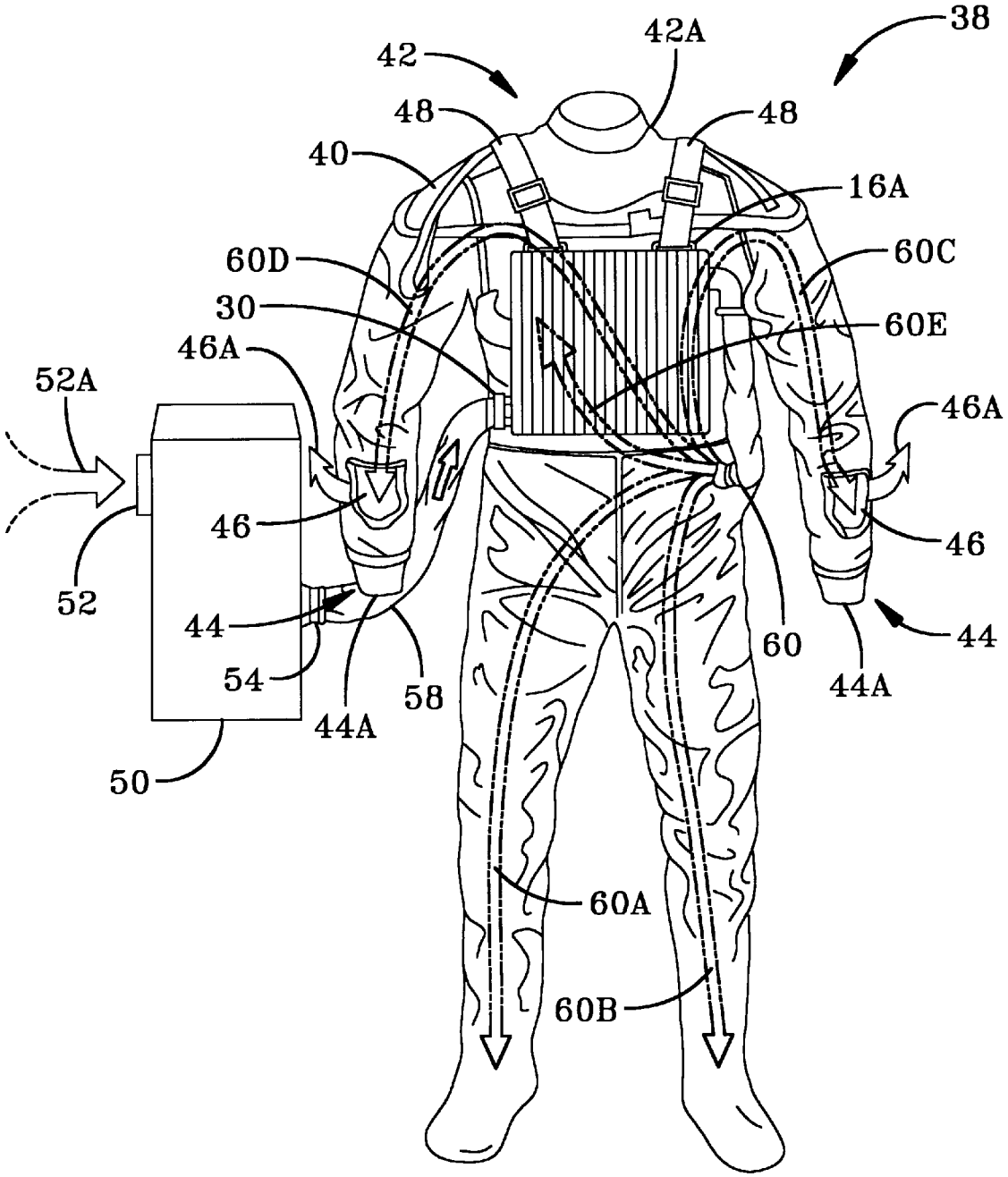
FIG. 3 illustrates a personal cooling apparatus in accordance with one embodiment of the present invention.

FIG. 3 illustrates a personal cooling apparatus 38 comprising a garment 40 which is donned by a user. The garment 40 may be an anti-exposure dry suit or Chem/Bio HAIL/SS assemblies, both known in the art. The garment 40 has a neck region 42 and cuff regions 44, each comprising a complementary region 42A and 44A respectively, comprised of synthetic rubber, such as buytl, and serving as a neck seal 42A and a cuff seal 44A respectively. The garment 40 further has vents 46 to allow air (shown by directional arrows 46A) to escape and are preferably located near the cuff regions 44. The unit 10 has means, such as shoulder straps 48, so that unit 10 may be arranged at the chest region of the user of the garment 40 by means of harness attachments 16A and 16B shown in FIG. 1. Because the unit 10 is preferably comprised of a high impact resistant material, such as Kevlar®, the unit 10 provides ballistic protection at the chest region of the user donning the personal conditioned air apparatus 38. The personal conditioned air apparatus 38 further comprises a source of fluid 50.

The source 50 of fluid has an input 52 that draws air (shown by directional arrow 52A) into source 50, and an output 54. The personal conditioned air apparatus employs fluid couplers 58 and 60 each having an input and an output, wherein the first coupler 58 has its input coupled to the output 54 of the source supply 50. The first coupler 58 supplies air to unit 10. The second coupler 60 has its input connected to the exit opening 28 of unit 10, more particularly to coupler 34, and its output is distributed throughout the garment 50 by means of branches 60A, 60B, 60C, 60D and 60E of coupler 60.

The personal conditioned air apparatus 38 provides cooling for areas of the body of the user, including the head of the user wearing enclosed head gear known in the art, having temperatures that are higher than other areas of the body. The cooling is provided by way of branches 60A, 60B, 60C, 60D and 60E, as shown in FIG. 3.

In operation, the embodiment is rendered operable by connecting all of the previously described fluid couplers and providing and activating a blower system serving as the source 50 of fluid, such as a blower which may be an AR5 blower used in the U.S. Navy or a similar blower that utilizes a 9–12 volt excitation and draws an average of about 2–3 amps. It is preferred that the source of fluid 50 be portable and carried by the user of the personal cooling apparatus 38.

The energization of the source 50 provides cool air which is drawn through the system into the unit 10 and across the internally filled tubes $\mathbf{38}_1 \ldots \mathbf{38}_N$ of Zeolite and out of the exit opening of unit 10. The unit 10 provides for cooling by means of the substance sealed within the tubes $\mathbf{38}_1 \ldots \mathbf{38}_N$ which cools and serves to cool the person that has donned the garment 38. A by-product of the Zeolite process is heat that would be dissipated through the convolutions in the outer case. That heat energy could be harnessed and used by disconnecting from the cooling hose and enclosing the device by means of a jacket or similar type of clothing. Hence, a reverse-cycle of capturing rather than dissipating heat.

It should now be appreciated that the practice of the present invention provides for a conditioned air apparatus for cooling and heating the user of the personal conditioning air apparatus of the present invention. Further, it should be appreciated that because the unit 10 is comprised of a high impact resisting characteristic the unit 10 provides for ballistic protection for the chest region where the device 10 is mounted.

Although the present invention has described a system primarily intended for military personnel, it should be appreciated that the practice of the present invention provides for means for cooling and heating a user so as to accommodate extreme climatic regions of the world.

It is understood that the invention is not limited to the specific embodiments herein illustrated and described but may be otherwise without departing in the spirit and scope of the invention.

What I claim is:

1. A unit for cooling with a circulating stream of fluid by means of evaporation;

a housing with four enclosed side walls wherein at least one of the sides of said housing has an outer surface which is convoluted and the face of said housing has a convoluted surface; an enclosed bottom, and a face comprised of a material having an impact resistance characteristic, said side walls including two oppositely disposed side walls one with an entrance opening and the other with an exit opening, said entrance opening capable of receiving a fluid having a predetermined flow rate and said exit opening capable of passing said fluid out of said housing, said housing containing a polymer material; and a plurality of tubes arranged in a side-by-side manner within said housing and containing a refrigerant.

2. The unit for cooling and heating according to claim 1, wherein said refrigerant comprises Zeolite.

3. The unit for cooling and heating according to claim 2, wherein said side walls of said housing have a length in the range from about 12 inches to about 14 inches and a height of about 1.5 inches, said bottom has a length in the range from about 12 inches to about 14 inches and a width in the range from about 12 inches to about 14 inches, and said face has a length in the range from about 12 inches to about 14 inches and a width in the range from about 12 inches to about 14 inches.

4. The unit for cooling and heating according to claim 1, wherein said fluid is air and wherein said entrance opening has means for being fluidly coupled to an output of a blower and said exit opening has means for being fluidly coupled to an input of said blower so that air flows across said plurality of tube within said housing.

5. The unit for cooling and heating according to claim 4, wherein said plurality of tubes are arranged in a side-by-side manner parallel to said side wall having said entrance opening and wherein said fluid that flows across said tubes containing said Zeolite and exits said exit opening experiences at temperature decreases in the range from about 4° F. to about 6° F.

6. The unit for cooling and heating according to claim 1, wherein said material having impact resistance is Kevlar® and, wherein said polymer material is polystyrene.

7. The unit for cooling and heating according to claim 1, wherein said housing and said tubes comprises a material having an impact resistance characteristic.

8. The unit for cooling and heating according to claim 7, wherein said material having impact resistance is Kevlar® para-aramid.

9. A personal cooling apparatus comprising:

(a) a garment having at least one vent opening and capable of being donned by a user; said user has a body with areas having temperatures higher than other body areas; said garment completely covering and encompassing said user except for head and hands thereof;

(b) a source of fluid having an input, an output and a return line;

(c) a plurality of fluid couplers comprising first and second couplers each having an input and an output; and (d) a cooling unit comprising;

(i) a housing with four enclosed side walls, an enclosed bottom, and a face comprised of a material having an impact resistance characteristic, said side walls including two oppositely disposed side walls one with an entrance opening and the other with an exit opening, said entrance opening having means for fluidly coupling to said output of said first coupler and receiving a fluid having a predetermined flow rate and said exit opening passing said fluid out of said housing and having means for fluidly coupling to said input of said second coupler; said second fluid coupler comprising a plurality of output branches each directed onto a respective area having a higher temperature thereat, and (ii) a plurality of tubes arranged in a side-by-side manner within said housing and containing a refrigerant.

10. The personal conditioned air apparatus according to claim 9, wherein said garment has neck regions and arms each having a cuff region, said neck and cuff regions each comprising a complementary region thereof comprising synthetic rubber.

11. The personal conditioned air apparatus according to claim 9, wherein said user has a body with a chest and wherein, said personal conditioned air apparatus further comprises means for locating said housing at said chest.

12. The personal conditioned air apparatus according to claim 11, wherein said housing and said tube comprise a material having an impact resistance characteristic.

13. The personal conditioned air apparatus according to claim 12, wherein said material having impact resistance is Kevlar® para-aramid.

14. The personal conditioned air apparatus according to claim 9, wherein said side walls of said housing have a length in the range from about 12 inches to about 14 inches and a height of about 1.5 inches, said bottom has a length in the range from about 12 inches to about 14 inches and a width in the range from about 12 inches to about 14 inches, and said face has a length in the range from about 12 inches to about 14 inches and a width in the range from about 12 inches to about 14 inches.

15. The personal conditioned air apparatus according to claim 9, wherein said fluid is air.

16. The personal conditioned air apparatus according to claim 9, wherein at least one of the sides of said housing has an outer surface which is convoluted and wherein said face of said housing has a convoluted surface.

17. The personal conditioned air apparatus according to claim 9, wherein said refrigerant comprises Zeolite.

18. A method for cooling a personal apparatus comprising the steps of:

(a) providing a garment having a vent opening and capable of being donned by a user having a body where one area of the body has temperatures higher than other body areas; said garment substantially covering and encompassing said user except for users head;

(b) providing a source of fluid having an input and an output;

(c) providing first and second fluid couplers each having an input and an output;

(d) providing a cooling unit comprising;

(i) a housing having means for being located within said garment and having four enclosed side walls, an enclosed bottom, and a face comprised of a material having an impact resistance characteristic; said side walls including two oppositely disposed side walls one with an entrance opening and the other with an exit opening; said entrance opening having means for fluidly coupling to said output of said first fluid coupler and receiving a fluid having a predetermined flow rate and said exit opening passing said fluid out of said housing and having means for fluidly coupling to said input of said second fluid coupler having its output distributed throughout said garment; and (ii) a plurality of tubes arranged in a side-by-side manner within said housing and containing a refrigerant, (e) positioning said housing at the chest of said user;

(f) fluidly coupling said entrance opening of said housing to said input of said first coupler and said exit opening of said housing to said input of the second coupler; said second fluid coupler having branches directed into respective areas having higher body temperatures;

(g) activating said source of fluid so that said fluid flows over said tubes.

19. The method for cooling and heating a personal apparatus according to claim 18, wherein the step of providing said garment further comprises providing a garment having neck regions and arms each having a cuff region, said neck and cuff regions each comprising a complementary region thereof comprising synthetic rubber.

20. The method for cooling and heating a personal apparatus according to claim 18, wherein said step of providing a housing further comprises providing a housing and tubes whose material has an impact resistance characteristic.

21. The method for cooling and heating a personal apparatus according to claim 20, wherein said material having impact resistance is Kevlar® para-aramid.

22. The method for cooling and heating a personal apparatus according to claim 18, wherein said provided housing has side walls having a length in the range from about 12 inches to about 14 inches and a height of about 1.5 inches, said bottom has a length in the range from about 12 inches to about 14 inches and a width in the range from about 12 inches to about 14 inches, and said face has a length in the range from about 12 inches to about 14 inches and a width in the range from about 12 inches to about 14 inches.

23. The method for cooling and heating the personal apparatus according to claim 18, wherein said provided fluid is air.

24. The method for cooling and heating a housing according to claim 18, wherein said refrigerant comprises Zeolite and wherein at least one said side of said provided housing has an outer surface which is convoluted and wherein said face of said housing has a convoluted surface for dissipating heat that is a by-product of the Zeolite cooling process.

* * * * *